United States Patent [19]

Flynn et al.

[11] 4,361,253

[45] Nov. 30, 1982

[54] LIQUID TRANSFER DEVICE

[75] Inventors: William E. Flynn, Chelsmford; Charles F. Mountain, Cambridge, both of Mass.

[73] Assignee: Instrumentation Laboratory Inc., Lexington, Mass.

[21] Appl. No.: 175,068

[22] Filed: Aug. 4, 1980

[51] Int. Cl.[3] ..... B67D 5/54

[52] U.S. Cl. ..... 222/162; 222/325; 222/398; 222/464; 141/18; 422/100

[58] Field of Search ..... 222/162, 160, 325, 327, 222/386, 464, 513, 514, 522, 525, 526, 319–321, 336, 341, 401, 394, 398; 422/100; 73/863.83–863.85, 864.34, 864.35, 864.82, 864.83; 239/327, 329; 141/2, 3, 18, 19, 25, 26

[56] References Cited

U.S. PATENT DOCUMENTS

| | | | |
|---|---|---|---|
| 1,658,720 | 2/1928 | Hein . | |
| 1,811,572 | 6/1931 | Ailes | 222/325 |
| 2,584,397 | 2/1952 | Pitman . | |
| 2,616,423 | 11/1952 | Kurkjian . | |
| 2,665,037 | 1/1954 | Zublin | 222/162 |
| 2,763,881 | 9/1956 | Riel | 222/327 |
| 2,865,370 | 12/1958 | Eattove . | |
| 3,004,718 | 10/1961 | Gorman | 239/327 |
| 3,146,920 | 9/1964 | Benjamin | 222/382 |
| 3,330,276 | 7/1967 | Gordon . | |
| 3,330,277 | 7/1967 | Gabriels . | |
| 3,336,924 | 8/1967 | Sarnoff et al. . | |
| 3,404,681 | 10/1968 | Fowler . | |
| 3,572,998 | 3/1971 | Anthon | 422/100 |
| 3,724,460 | 4/1973 | Gomez et al. . | |
| 3,828,779 | 8/1974 | Ogle . | |
| 3,831,816 | 8/1974 | Pavliukonis | 222/386 |
| 3,872,867 | 3/1975 | Killinger . | |
| 3,900,028 | 8/1975 | McPhee . | |
| 3,923,059 | 12/1975 | Ogle . | |
| 3,945,382 | 3/1976 | Ogle . | |
| 3,945,383 | 3/1976 | Bennett et al. . | |
| 3,977,555 | 8/1976 | Larson . | |
| 3,993,063 | 11/1976 | Larrabee . | |
| 4,037,464 | 7/1977 | Wenardet | 422/100 |
| 4,116,196 | 9/1978 | Kaplan et al. . | |
| 4,169,475 | 10/1979 | Genese . | |
| 4,180,070 | 12/1979 | Genese . | |
| 4,275,774 | 6/1981 | Andersen et al. | 222/325 |

*Primary Examiner*—H. Grant Skaggs

[57] ABSTRACT

A device for dispensing liquid from an ampul or the like has a body that defines a cavity with an open entrance end for receiving an ampul. An annular seal in the cavity is in sealing engagement with an ampul as the ampul is telescopically inserted into the cavity, and an inlet tube secured in the cavity has an inlet end adjacent the open end of the cavity and an outlet end in fluid communication with a dispensing passage, so that when an ampul is in sealing engagement with the annular seal and the inlet end of the tube is submerged in liquid in the ampul, further axial movement of the ampul into the cavity creates a piston action which compresses air trapped in the cavity and forces liquid from the ampul through the inlet tube and the dispensing passage in a dispensing action.

9 Claims, 6 Drawing Figures

FIG 1
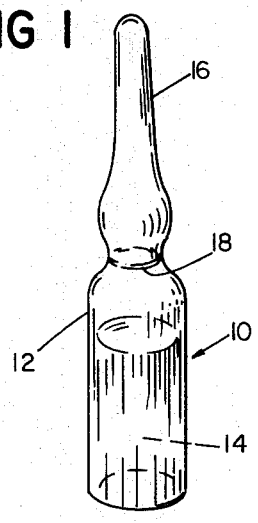
FIG 2
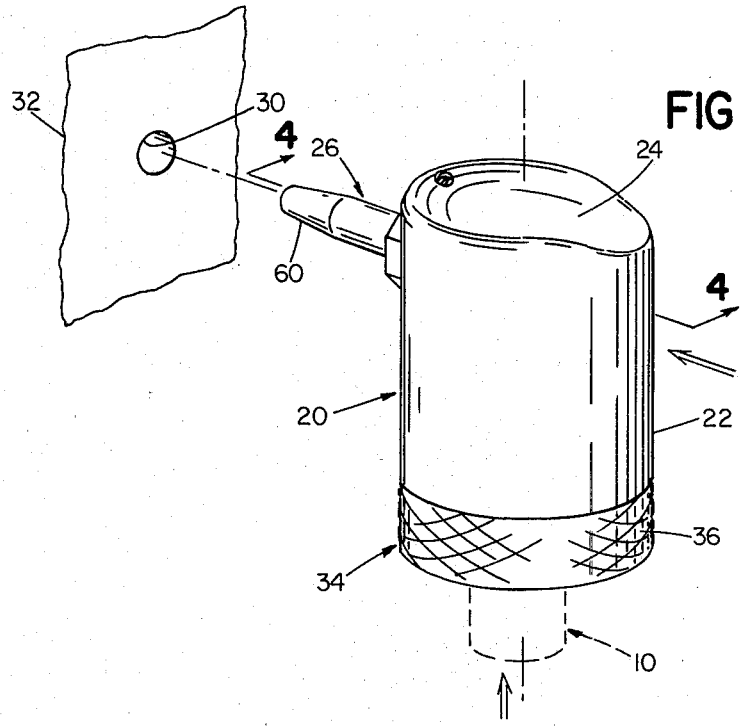
FIG 3
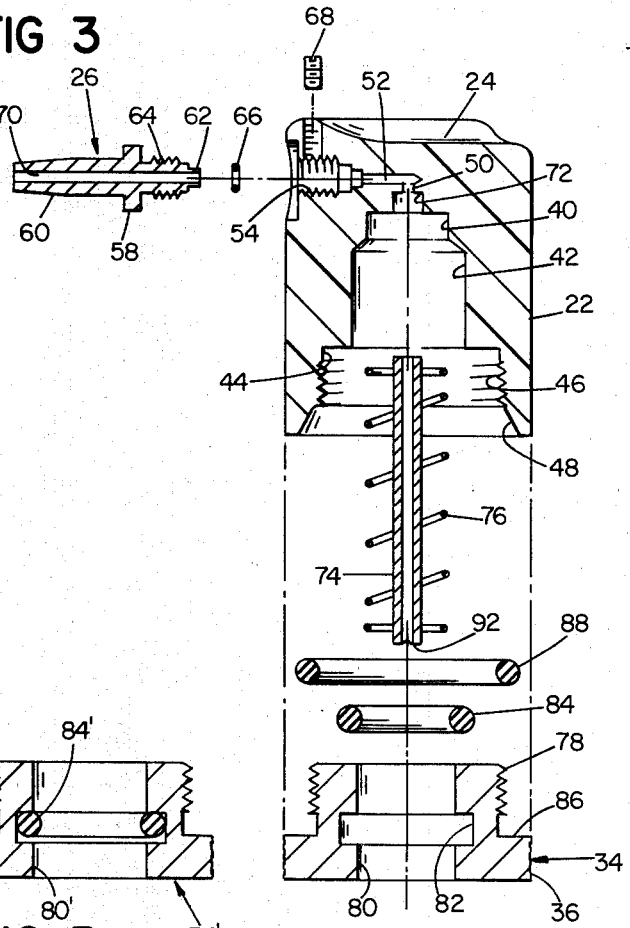
FIG 4
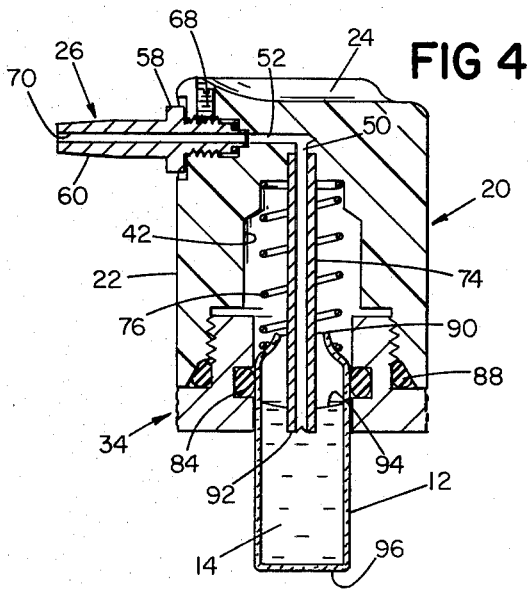
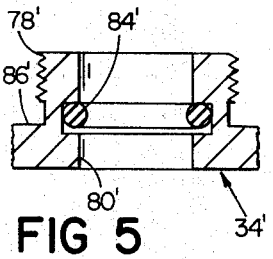
FIG 5
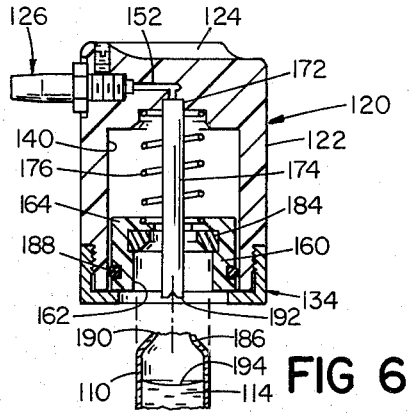
FIG 6

LIQUID TRANSFER DEVICE

This invention relates to liquid transfer devices, and more particularly to devices particularly useful in transferring liquids from dose vials and ampuls.

Small quantities of liquids are frequently packaged in dose vials or ampuls for use in medical applications or with medical instrumentation. The liquid should be transferred from the vial or ampul with minimal contamination. Prior art arrangements for such purpose include a hypodermic needle type syringe which is inserted into the vial for withdrawal of liquid for injection into a user site; vials with pistons within the vial; and dispenser devices with separate manually actuated piston members.

In accordance with the invention there is provided a dispenser for discharging liquid from an ampul or the like through the open end of the ampul with minimum contamination with air. The dispenser has a body that defines a cavity designed to telescopically receive an opened ampul. An inlet tube extends from the entrance end of the cavity to a dispensing passage and an annular seal disposed adjacent the entrance end of the cavity sealingly engages the body of the ampul as it is inserted into the cavity. When the inlet end of the tube is submerged in the liquid in the ampul and the ampul is manually pushed further into the cavity, a resulting piston action compresses air trapped in the cavity above the liquid surface and liquid is forced from the ampul (from a location below the surface of the liquid) through the inlet tube and dispensing passage in a dispensing action. Withdrawal of the ampul from the cavity draws air through the inlet tube in a reverse flow flushing action.

In one particular embodiment, the seal is carried by a removable cap member which can be interchanged with other caps of different entrance port sizes to accommodate different ampul sizes; while in another embodiment the seal is carried by a piston member housed in the cavity. The inlet tube extends coaxially through the cavity and a spiral compression spring that is disposed in the cavity over the inlet tube provides an ejection action that aids in withdrawal of the ampul following dispensing. In particular embodiments, designed for dispensing control liquid from an ampul into a blood gas analysis instrument, the body has a Luhr fitting in a side wall for engagement with a cooperating receptacle in a blood gas analyzer or the like. In operation, the first portion of the liquid leaving the ampul is used for flushing the inlet port and measuring chambers of the analyzer, and for pushing atmospheric air or calibrating gases from the system. Hence, that portion of the control liquid which is subjected to analysis is transferred anaerobically into a system already flushed with the same liquid.

The invention provides a simple, compact and versatile dispenser for dispensing liquids from ampuls, dose vials or the like. Other features and advantages of the invention will be seen as the following description of particular embodiments progresses, in conjunction with the drawings, in which:

FIG. 1 is an ampul which contains a control solution designed for in vitro diagnostic use in monitoring the pH, $pCO_2$, and $pO_2$ measurements of blood gas analyzers;

FIG. 2 is a perspective view of a dispenser device in accordance with the invention for use with the ampul shown in FIG. 1;

FIG. 3 is an exploded sectional view of components of the dispenser shown in FIG. 2;

FIG. 4 is a sectional view taken along the line 4—4 of FIG. 2, showing details of the dispenser;

FIG. 5 is a sectional view of a different end cap adapted to accommodate an ampul of larger diameter; and FIG. 6 is a sectional view similar to FIG. 4, showing another dispenser device.

DESCRIPTION OF PARTICULAR EMBODIMENTS

The ampul 10 shown in FIG. 1 includes a cylindrical body portion 12 that contains a control liquid 14, a buffered solution tonometered with specific concentrations of carbon dioxide and oxygen. The ampul includes a tip portion 16 attached to the body portion 12 at a break line 18. The ampul has an overall length of about six centimeters; the body 12 of a one milliliter capacity ampul has an outer diameter of about one centimeter and a length of about two centimeters while the body 12 of a two milliliter capacity ampul has an outer diameter of about 1.2 centimeters and an overall length of about 2.5 centimeters.

The dispenser 20, as shown in FIGS. 2–4, includes a cylindrical body portion 22 about 2.5 centimeters in diameter and four centimeters in height. Top surface 24 provides a shaped thumb receiving recess. A Luhr fitting 26 projects from one side for insertion into receiving port 30 (or insertion over a projecting inlet tube) of a blood gas analysis instrument 32. End cap 34 is threadedly secured to the base of body 22 and has a knurled cylindrical surface 30 about $\frac{3}{4}$ centimeter in height.

Formed in body 22 is an upper cylindrical cavity 40 about one centimeter in length and 0.5 centimeter in diameter, an intermediate cylindrical cavity 42 about 1.5 centimeter in length and 1.25 centimeter in diameter, and a lower cavity 44 about one centimeter in length and two centimeters in diameter. Formed in wall 44 is a threaded section 46 and a frustoconical surface 48.

Body 20 has a stub passage 50 at the upper end of the cavity and a transverse passage 52 that leads to a tapped port 54. Stainless steel Luhr fitting 26 has a hexagonal shoulder 58, a nose portion 60 about 1.4 centimeter long, the leading end of which is slightly tapered, and a seat 62 to the rear of threaded section 64 that receives O-ring 66. Fitting 26 has a 1.3 millimeter diameter through passage 70 and is secured in port 54 by set screw 68. Passage 50 has a counter bore 72 that receives fifteen gauge stainless steel tube 74 (about four centimeters long) and which is secured in counterbore 72 by epoxy or other suitable bonding agent. The upper end of compression spring 76 is similarly secured in cavity 40.

End cap 34 has a knurled surface 36 and a threaded section 78 that mates with threaded section 46 in body 20. Formed in the inner wall 80 of cap 34 is a recess 82 for receiving O-ring 84. Seated on the upper end surface 86 of cylindrical section 36 is a second sealing O-ring 88. When end cap 34 is threaded into the base of housing body 20, O-ring 88 is compressed against frustoconical surface 48 to provide a cavity seal and the end 92 of tube 74 does not protrude beyond end cap 34. The compact assembled dispenser is shown in FIG. 4.

In use, ampul 10, just prior to use, is shaken vigorously. The top 16 is then snapped off, and the fractured end 90 is inserted through the opening in end cap 34, as shown in FIG. 4, so that the outer surface of the ampul body 12 is frictionally and sealingly secured by O-ring 84 and spring 76 is slightly compressed. In this position, the end 92 of tube 74 is submerged beneath the surface 94 of the liquid 14 in the ampul. Fitting 26 of the dispenser unit is inserted into the cooperating port 30 of the analyzer, and finger pressure is exerted between the top surface 24 of the housing 20 and the bottom surface 96 of the ampul 10 to slide the ampul into the housing cavity. As the cavity chamber above the ampul 10 is sealed by O-rings 84 and 88, and the end 92 of tube 74 is below the surface 94 of the liquid 14, this inward motion of the ampul increases the pressure in the chamber, which pressure acts against the surface of the liquid 14, forcing that liquid through the tube 74 and passages 50, 52 and fitting 26 into the analyzer 32. Flow is always from below surface 94, as that surface remains in the same position relative to tube end 92 as ampul 10 is pushed into the dispenser cavity, compressing spring 76.

After the ampul 10 has been slid all the way into the housing in the dispensing action, it is released and spring 76 drives it out of the cavity and allows its easy removal from the dispenser.

An alternate end cap 34', shown in FIG. 5, fits into the threaded section 46 of body 20 and has a larger diameter inner wall 80' (about 1.2 centimeters) and a larger diameter O-ring 84' to receive a larger (two milliliter) ampul.

Shown in FIG. 6 is another embodiment of a dispenser in accordance with the invention. That dispenser 120 includes body portion 122 that has top surface 124 shaped to provide a thumb receiving recess. Fitting 126 is designed for engagement with a cooperating inlet port of a blood gas analyzer. Formed in body 122 is a cylindrical cavity 140, and inlet tube 174 extends coaxially toward the open end of cavity 140 from counterbore 172 at its closed end.

Mounted for axial movement within cavity 140 is a piston 160. Retainer cap 134 holds piston 160 within cavity 140 and compression spring 176 biases piston 160 downwardly against cap 134. The outer cylindrical surface of piston 160 has an annular groove that receives O-ring seal member 188; the piston skirt defines a cylindrical recess 162 with a soft seal member 184 secured at the upper end of recess 162 against piston head 164.

Use of the dispenser shown in FIG. 6 is similar to that of the dispenser shown in FIG. 4. After the top of an ampul 110 is snapped off, the fractured end 190 is inserted into the piston cavity defined by cylindrical skirt 162 so that the conical surface 186 of the ampul is seated against the soft seal 184. Fitting 126 of the dispenser unit is engaged with a cooperating inlet of the analyzer instrument, and finger pressure is exerted between top surface 124 of housing 120 and the bottom of the ampul to slide the ampul (and piston 160) into the housing cavity compressing spring 176. After the end 192 of tube 174 is submerged beneath the surface 194 of the liquid 114 in the ampul, further inward motion of the ampul increases the pressure in the cavity chamber above piston 160, which pressure acts against the surface of the liquid 114 and forces that liquid through tube 174, passage 152, and fitting 126 into the analyzer. After the ampul 110 has been slid all the way into the housing in a dispensing action, the ampul is released and spring 176 returns piston 160 to its lower position against retainer cap 134. A range of ampul diameters are accommodated with the dispenser shown in FIG. 6, with seal 184 seated against the conical surfaces 186 of the ampuls.

While particular embodiments of the invention have been shown and described, various modifications will be apparent to those skilled in the art and therefore it is not intended that the invention be limited to the disclosed embodiment or to details thereof and departures may be made therefrom within the spirit and scope of the invention.

What is claimed is:

1. A device for dispensing liquid from an ampul or the like comprising a body that defines a cavity, said cavity having an open entrance end for receiving an ampul and a closed end spaced from said open entrance end, structure defining a dispensing port and a passage providing fluid communication between said dispensing port and said cavity, an annular seal in said cavity for sealing engagement with an ampul as the ampul is telescopically inserted into said cavity, inlet tube structure in said cavity having an inlet end located adjacent the open end of said cavity and an outlet in fluid communication with said passage, said annular seal arranged for cooperation with an ampul inserted into said cavity to permit further axial movement of said ampul into said cavity when said ampul is in sealing engagement with said annular seal and the inlet end of said inlet tube structure is submerged in liquid in the ampul so that said further axial movement of said ampul into said cavity creates a piston action which compresses air trapped in said cavity and forces liquid from said ampul through said inlet tube structure, said passage and said dispensing port in a dispensing action, and biasing means in said cavity for engaging the ampul and tending to urge the ampul outwardly of said cavity upon release of the ampul after dispensing action is completed.

2. The device of claim 1 wherein said biasing means is a spiral compression spring disposed coaxially over said inlet tube and one end of said spring is secured at said closed end of said cavity.

3. The device of claim 1 wherein said dispensing port structure is in a side wall of said body and includes a Luhr-type fitting.

4. The device of claim 1 wherein said annular seal surrounds said inlet tube and is fixed in position adjacent said entrance end of said cavity.

5. The device of claim 4 and further including a replaceable end cap member, said end cap member carrying said annular seal and defining said open end of said cavity.

6. A device for dispensing liquid from an ampul or the like comprising a body that defines a cavity, said cavity having an open entrance end for receiving an ampul and a closed end spaced from said open entrance end, structure defining a dispensing port and a passage providing fluid communication between said dispensing port and said cavity, an annular seal in said cavity for sealing engagement with an ampul as the ampul is telescopically inserted into said cavity, an inlet tube secured in said cavity and having an inlet end located adjacent the open end of said cavity and an outlet end secured at the closed end of said cavity in fluid communication with said passage, said inlet tube extending towards the open end of said cavity with its inlet end located between said annular seal and said entrance end of said cavity, said annular seal arranged for cooperation with an ampul inserted into said cavity to permit further axial movement of said ampul into said cavity when said ampul is in sealing engagement with said annular seal and the inlet end of said tube is submerged in liquid in the ampul so that said further axial movement of said ampul into said cavity creates a piston action which compresses air trapped in said cavity and forces liquid from said ampul through said inlet tube, said passage and said dispensing port in a dispensing action.

7. A device for dispensing liquid from an ampul or the like comprising a body that defines a cavity, said cavity having an open entrance end for receiving an ampul and a closed end spaced from said open entrance end, structure defining a dispensing port and a passage providing fluid communication between said dispensing port and said cavity, inlet tube structure in said cavity having an inlet end located adjacent the open end of said cavity and an outlet in fluid communication with said passage, an annular seal in said cavity for sealing engagement with an ampul as the ampul is telescopically inserted into said cavity, said annular seal surrounding said inlet tube structure and being mounted for axial movement within said cavity, said annular seal arranged for cooperation with an ampul inserted into said cavity to permit further axial movement of said ampul into said cavity when said ampul is in sealing engagement with said annular seal and the inlet end of said inlet tube structure is submerged in liquid in the ampul so that said further axial movement of said ampul into said cavity creates a piston action which compresses air trapped in said cavity and forces liquid from said ampul through said inlet tube structure, said passage and said dispensing port in a dispensing action.

8. The device of claim 7 and further including a piston member mounted for axial movement within said cavity, said piston member carrying said annular seal and defining a recess for receiving the ampul.

9. The device of any one of claims 6, 5 or 8 wherein the outlet end of said inlet tube is secured at the closed end of said cavity in fluid communication with said passage and said inlet tube extends axially through said cavity towards the open end thereof with its inlet end located axially between said annular seal and said entrance end of said cavity, and further including a spiral compression spring disposed coaxially over said inlet tube with one end of said spring secured at the closed end of said cavity, said spring tending to urge the ampul outwardly of said cavity through said entrance end after dispensing action is completed.

* * * * *